US005979295A

United States Patent [19]

Larker et al.

[11] Patent Number: 5,979,295

[45] Date of Patent: Nov. 9, 1999

[54] HYDRAULIC MOTOR PISTON

[75] Inventors: Richard Larker, Luleå ; Bengt Liljedahl; Torsten Svensson, both of Bredbyn, all of Sweden

[73] Assignee: Hägglunds Drives AB, Mellansel, Sweden

[21] Appl. No.: 09/057,438

[22] Filed: Apr. 9, 1998

[30] Foreign Application Priority Data

Apr. 10, 1997 [SE] Sweden ..... 9701316

[51] Int. Cl.[6] ..... F01B 13/06

[52] U.S. Cl. ..... 92/58; 92/72; 92/255; 91/491

[58] Field of Search ..... 92/12.1, 58, 72, 92/255, 259; 91/491

[56] References Cited

U.S. PATENT DOCUMENTS

| | | | |
|---|---|---|---|
| 2,599,609 | 6/1952 | Carey | 92/58 |
| 4,724,743 | 2/1988 | Eickmann | 91/491 |
| 4,926,744 | 5/1990 | Eickmann | 92/72 |
| 5,391,059 | 2/1995 | Hallundback | 92/58 |
| 5,622,052 | 4/1997 | Fähnle | 92/12.1 |

FOREIGN PATENT DOCUMENTS

| | | |
|---|---|---|
| 524437 | 6/1996 | European Pat. Off. . |
| 503563 | 7/1996 | Sweden . |

*Primary Examiner*—Thomas E. Denion

*Attorney, Agent, or Firm*—Burns, Doane, Swecker & Mathis, L.L.P.

[57] ABSTRACT

The present invention relates to a piston intended for a hydraulic radial piston motor and being of the type comprising an outer cam ring having an undulated inner cam surface, an inner cylinder block which is rotatable relative to the cam ring and has radially outwardly directed cylinders, a plurality of such pistons which move in said cylinders and cam rolls which rollingly run against the cam surface and are slidingly arranged against the respective pistons. The piston has an essentially cylindrical circumferential surface, an inner end surface and an opposite outer end surface, which is adapted to be slidingly arranged against the cam roll and therefore is formed with a groove-like recess, which in cross-section is essentially part-cylindrical, and with two lateral portions which extend around and partly surround the circumferential surface of the cam roll and via which reaction forces in the tangential direction of the cylinder block are transmitted between the cam roll and the cylinder block. The lateral portions of the piston are designed as separate parts, which are movable in the longitudinal direction of the piston at least in a limited manner.

20 Claims, 1 Drawing Sheet

HYDRAULIC MOTOR PISTON

FIELD OF THE INVENTION

The present invention relates to a piston intended for a hydraulic radial piston motor and being of the type comprising an outer cam ring having an undulated inner cam surface, an inner cylinder block which is rotatable in relation to the cam ring and has radially outwardly directed cylinders, a plurality of such pistons moving in said cylinders, cam rolls which rollingly run against the cam surface and are slidably arranged against the respective pistons, and a distributing valve which distributes a hydraulic medium to the cylinders in the working stroke of the respective pistons and from the cylinders in the return stroke of the respective pistons, the piston having an essentially cylindrical circumferential surface, an inner end surface which is adapted to be directed towards the center of the cylinder block and be exposed to pressure exerted by the hydraulic medium, and an opposite outer end surface which is adapted to be slidingly arranged against the cam roll and therefore is formed with a groove-like recess which in cross-section has an essentially part-cylindrical shape with a symmetry axis extending perpendicular to the longitudinal axis of the piston, and two lateral portions which extend around and partly surround the circumferential surface of the cam roll and via which reaction forces in the tangential direction of the cylinder block are transmitted between the cam roll and the cylinder block.

BACKGROUND ART

Hydraulic radial piston motors having an outer cam ring and outwardly working pistons, which are in contact with the cam surface of the cam ring via rotating cam rolls, are available in two main types, on the one hand a type in which the cam roll is mounted in roller bearings on the end of a shaft connected to the piston and, on the other hand, a type in which the cam roll is slidably arranged directly against the piston in a recess thereof.

The last-mentioned type, which corresponds to the one accounted for in the introductory part, has a number of advantages both in respect of size and cost by the height of the assembled piston and cam roll being considerably smaller than that of the first-mentioned type, which means that the motor can be made smaller and more compact with maintained output.

However there are also problems and drawbacks in connection with radial piston motors with slidably mounted cam rolls. For instance, the frictional losses between piston and cam roll are relatively great. These losses are about four times greater than the corresponding frictional losses between piston and cylinder wall. These great frictional forces imply considerable wear on the slide bearing surfaces and, consequently, a risk of seizing therebetween.

The seizing risk is dependent not only on the great forces which are transmitted between cam ring and cylinder block, but also on the varying reaction force exerted by the cam ring. The undulated cam surface thereof in fact varies by an angle between 0° and a maximum of about 45° in relation to the tangential direction of the can ring and the cylinder block. Correspondingly, the reaction force exerted by the cam ring on the piston and the cylinder block will vary between 0° (i.e. radially inwards to the center of rotation) and about 45°. This variation of forces has up to now made it impossible to form a constant oil film thickness between the bearing surfaces between cam roll and piston, and piston and cylinder wall, respectively. The variation in forces will also during a certain part of the working stroke of the piston coincide with the direction of rotation of the cam roll, implying that the cam roll, mechanically seen, acts as having a very low speed or even "standing still" in relation to the bearing surface of the piston. This further reduces the possibilities of forming a constant oil film thickness. A varying thickness of the oil film in turn results in an increased metallic contact between the bearing surfaces, which causes increased wear, a greater risk of seizing, greater frictional forces and reduced efficiency.

Pistons with slidably mounted cam rolls are also expensive to manufacture owing to the complicated shape, which requires precision machining in several steps.

Owing to the small material thickness in the lateral portions of the piston and the great forces acting on these, it is also necessary that the entire piston be made of a high-quality material.

SUMMARY OF THE INVENTION

The present invention aims at obviating the above problems and drawbacks which are associated with pistons of the type mentioned by way of introduction and providing a piston which in terms of cost is advantageous to manufacture, has a more favorable transmission of forces between cam roll and cylinder block, thus eliminating or at least reducing the varying reaction forces acting on the cam roll, which in turn makes it possible to form an oil film with a constant thickness between the bearing surfaces, which results in lower friction, a reduced risk of seizing and greater efficiency. Besides the invention aims at enabling the use of an inexpensive material with reduced strength in the piston body. At least these objects are achieved by a piston according to claim 1.

According to an alternative embodiment of the invention as claimed in claim 5, it is also an object to further reduce the frictional losses, reduce the wear and the risk of seizing, without the piston being unnecessarily expensive to manufacture, by making the lateral portions of the piston of a material with good frictional and wear properties, particularly relative to iron/steel.

The invention thus is based on the knowledge that the friction between the bearing surfaces between cam roll and piston, and piston and cylinder wall, respectively, can be reduced to a considerable extent by designing the lateral portions of the piston as separate portions which are movable in relation to the rest of the piston or the piston body. The favorable effect is achieved even if the lateral portions are made of the same material as before. The reason for this is that the distribution of forces in the piston or the transmission of forces therethrough is simplified by the separate lateral portions only being able to absorb and transmit the forces which are directed perpendicular to the cylinder wall, i.e. tangentially in relation to the cylinder block and radially in relation to the piston. Since this results in a constant direction of forces, it will also be possible to form an oil film of constant thickness, which is favorable for the lubrication of the bearing surfaces and reduces the frictional losses as well as the wear and the risk of seizing. The invention also affords possibilities of making the smaller lateral portions of a more expensive material with better frictional properties, for instance ceramics made of a material based on silicon nitride, without affecting the total cost of the piston to a considerable extent. At the same time it is also possible to make the piston body of a cheaper material. According to claim 7, it is also possible to provide the lateral portions with a hard surface coating of some suitable material.

The lateral portions can as a rule be completely free in relation to the rest of the piston, i.e. they are displaceable in the longitudinal extent of the piston in an unlimited manner. By designing the lateral portions to have a sliding surface with an angle of contact around the cam roll, which extends both in front of and behind a plane perpendicular to the longitudinal axis of the piston and through the center of the cam roll, the lateral portions will follow the motion of the cam roll towards and from the center of rotation. In the radial and tangential direction of the piston, the lateral portions will be held in place by being guided by the cylinder wall and the cam roll. In a preferred embodiment of the invention, the lateral portions will, however, not abut against and be controlled by the piston body since they are preferably made with undersize, such that in normal operation there is a small gap between the piston body and the lateral portions. This gap can suitably amount to about 0.4 mm. This does not only decrease the required dimensional tolerances and, thus, also the manufacturing cost, but moreover the mode of function of the different parts of the piston can be refined when the parts do not contact and affect each other. In a preferred embodiment, the radial force is absorbed by the piston body via a hydrostatic slide bearing, for instance, in a prior-art manner via a through oil hole from the top of the piston and an annular oil duct in the slide bearing surface of the piston body, whereas the tangential force is absorbed by the lateral portions via a hydrodynamic slide bearing.

In some cases, such as where the motor is used to drive a winch, there may be a need of letting the motor operate in a "free-wheeling" manner, i.e. rotate without driving or braking, and to this end a device may be arranged, which jointly retracts all pistons to the center of rotation. The lateral portions can then be made displaceable in a limited manner, suitably with the aid of some sort of hook means between the piston body and the respective lateral portions, such that the lateral portions accompany the piston when this is displaced to the center of rotation and, thus, pull along also the cam roll. Such a motion-limiting means can be designed in various ways. A basic property is, however, that it should be inactive, i.e. not affect the lateral portion, in normal states of operation when a hydraulic pressure acts on the top of the piston and an opposed force from the cam ring acts on the cam roll.

The division between the piston body and the lateral portions may have different geometric designs. In the detailed description below and in the drawings, a preferred embodiment is described and shown, in which the division extends diagonally obliquely outwards from the cam roll in the direction of the top of the piston, with flat connecting surfaces between the piston body and the lateral portions. As a result, the lateral portions obtain a tapering shape, in respect of both thickness and width, in the direction of the top of the piston. This is advantageous for several reasons. On the one hand, the consumption of material for manufacturing the lateral portions will be small, which is an advantage if these are to be made of an expensive high-quality material and, on the other hand, the wedge shape will facilitate the centering and returning of the lateral portions if, for some reason, the piston body and the cam roll are separated during operation.

The connecting surfaces between the piston body and the lateral portions need not be flat but can be curved, for instance, the piston body can have a convex surface and the lateral portions a concave so as to further decrease the volume of the material.

In practical tests, it has surprisingly been found that the oil leakage via the cylinders is smaller than when using prior-art pistons, although there is a gap of about 0.4 mm between the parts of the piston. This depends on the fact that the piston body and the lateral portions are each free to adapt separately to the cam roll and form oil films of a more uniform thickness.

DETAILED DESCRIPTION OF A PREFERRED EMBODIMENT OF THE INVENTION

Figure 1:
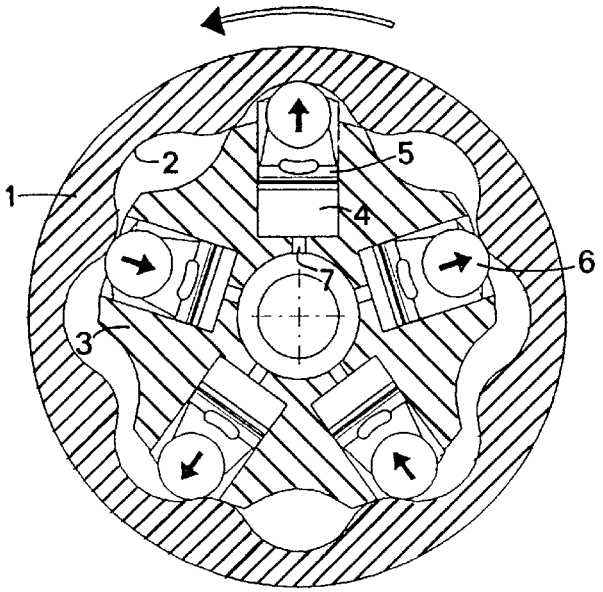
FIG. 1 is a schematic cross-section of a hydraulic radial piston motor with pistons according to the present invention.
Figure 2:
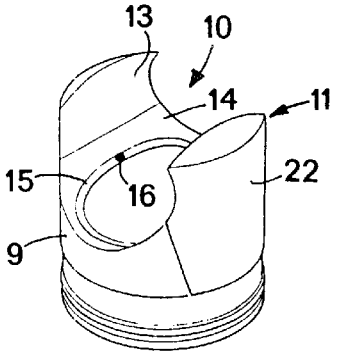
FIG. 2 is a perspective view of a preferred embodiment of an inventive piston.

Reference is first made to FIG. 1, which shows, in a schematic cross-section, the principle of the function and design of a hydraulic radial piston motor with slidingly mounted cam rolls. In the Figure, a cam ring is designated 1 and has on its inside an undulated cam surface 2. A cylinder block is designated 3 and is fitted with five cylinders 4 directed radially outwards. The cam ring 1 and the cylinder block 3 are concentric and/or coaxial and rotatable relative to each other. In practical applications, it is possible to let the cam ring rotate around a stationary cylinder block or to let the cam ring be fixed while the cylinder block rotates inside the cam ring. In each cylinder moves a piston 5, which in its outer end facing the cam ring is slidably arranged against a cam roll 6, which in turn abuts against and moves rollingly against the cam surface 2 of the cam ring. A distributing valve (not shown) distributes the hydraulic medium via ducts 7 to the cylinders in their working stroke and evacuates the hydraulic medium from the cylinders in their return stroke.

Reference is then made to FIGS. 2–5, which show the detailed design of a piston according to the present invention. This comprises a top 8 of the piston, an essentially cylindrical circumferential surface 9 and an outer end facing the cam ring and having a groove-like recess 10 of part-cylindrical cross-section.

Two opposite, loosely arranged lateral portions or segments are designated 11 and, at an inner end portion, are arranged spaced from the piston body via a recess therein and, at an outer end portion, extend beyond and partly surround the circumferential surface of the cam roll. In the embodiment shown, the lateral portions essentially have the shape of a segment which tapers towards the top of the piston and which in cross-section has the form of a circular segment with an outer part-cylindrical circumferential surface 22, which, in the mounted state of the lateral portion, is adapted to connect to the circumferential surface of the piston body and be slidingly arranged against the cylinder wall, and an inner flat surface 12, which via a gap connects with a corresponding seat of the piston body. On the inside of the outer portion of each lateral portion there is arranged a slide bearing surface 13 which is part-cylindrical in cross-section and whose symmetry axis extends perpendicular to the longitudinal axis of the piston. In the mounted state of the lateral portions, the slide bearing surface 13 serves to constitute part of the slide bearing surface against the cam roll and connects to a corresponding slide bearing surface 14 of the piston body. In the embodiment shown, the slide bearing surface 13 is, as is best seen from FIG. 5, centered around a plane extending perpendicular to the longitudinal axis of the piston and through the center of the cam roll. This is not a condition for the function of the invention, but by letting the slide bearing surface 13 extend both in front of and behind this plane, it is ensured that the lateral portions follow the translational motion of the cam roll, and it is also made possible to hold the cam roll in case of "free wheeling" if some sort of motion-limiting means is arranged between the piston and the lateral portions.

Figure 4:
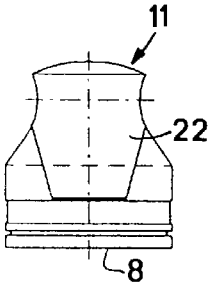
FIG. 4 is a side view of the piston in FIG. 2.
Figure 5:
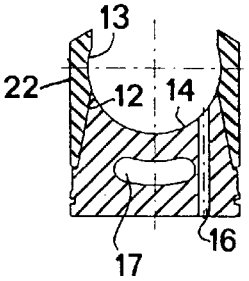
FIG. 5 is a cross-section of the piston in FIGS. 2 and 4.

Further it is evident from FIGS. 4 and 5 that a play is arranged between the inner end surfaces of the lateral portions and a bottom wall of the recess in the piston body. An oil duct is designated 16 and is intended to conduct oil from the top of the piston to the slide bearing surfaces between piston and cam roll, and an annular oil duct is designated 15, via which the oil is distributed uniformly across the slide bearing surface 14 of the piston body. Consequently, this will act as a hydrostatic slide bearing surface while the slide bearing surfaces 14 of the lateral portions are hydrodynamic. A cavity is shown at 17.

Figure 3:
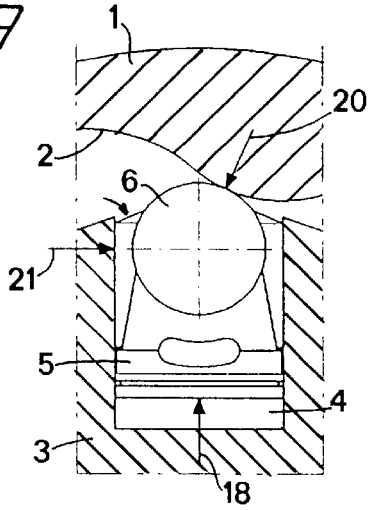
FIG. 3 is an enlarged detail of the cross-section in FIG. 1, showing a piston in a working stroke.

FIG. 3 is a cross-sectional view of an enlarged portion of the hydraulic motor according to FIG. 1 and illustrates a cylinder with a piston according to the invention which is at the beginning of a working stroke. Arrows schematically indicate the forces acting on the piston, and arrow 18 indicates the resulting force from the hydraulic medium acting on the top of the piston. This force is propagated via the piston and the cam roll to the cam ring. A reaction force 20 from the cam ring acts on the cam roll perpendicular to the tangent of the cam surface 2 at the point of contact. By the lateral portions 11 being displaceably arranged relative to the piston body, these will transmit only forces which are perpendicular to the slide bearing surfaces between the lateral portions and the cylinder wall. The reaction force 20 from the cam ring will therefore be equalized not only by the hydraulic pressure 18 but also by a force 21 which is tangentially directed in relation to the direction of rotation and which produces the torque of the motor. As mentioned above, this is advantageous for the forming of an oil film with a constant thickness between the slide bearing surfaces between lateral parts and cam roll and, as a result, reduced wear and greater efficiency. The forces 20 and 21 cause the cam ring and the cylinder block to rotate in relation to each other while the piston and the cam roll are moved further away from the center of rotation.

Possible Modifications of the Invention

It goes without saying that the invention can be modified in many ways within the scope of the appended claims. For example, the lateral portions 11 can have a different shape and size as well as a different angle of contact of the slide bearing surface 13 and a different length of the connecting surface against the piston body. The connecting surface can, of course, also have a different design and, for instance, be fitted with some sort of motion-limiting means as mentioned above. Also the piston body can be designed in a different manner, for instance, by omission of the cavity 17.

What we claim and desire to secure by Letters Patent is:

1. A piston intended for a hydraulic radial piston motor and being or the type comprising an outer cam ring having an undulated inner cam surface, an inner cylinder block which is rotatable in relation to the cam ring and has radially outwardly directed cylinders, a plurality of such pistons moving in said cylinders, cam rolls which rollingly run against the cam surface and are slidably arranged against the respective pistons, and a distributing valve which distributes a hydraulic medium to the cylinders in the working stroke of the respective pistons and evacuates the hydraulic medium from the cylinders in the return stroke of the respective pistons, the piston having an essentially cylindrical circumferential surface, an inner end surface which is adapted to be directed towards the center of the cylinder block and be exposed to pressure exerted by the hydraulic medium, and an opposite outer surface which is adapted to be slidingly arranged against the cam roll and therefore is formed with a groove-like recess which in cross-section has an essentially part-cylindrical shape with a symmetry axis extending perpendicular to the longitudinal axis of the piston, and two lateral portions which extend around and partly surround the circumferential surface of the cam roll and via which reaction forces in the tangential direction of the cylinder block are transmitted between the cam roll and the cylinder block, characterized in that the lateral portions of the piston are formed as separate parts, which each have an outer part-cylindrical slide bearing surface which is adapted to be slidingly arranged against the cylinder wall, and an inner part-cylindrical slide bearing surface which is adapted to be slidingly arranged against the cam roll, the symmetry axes of the slide bearing surfaces being perpendicular to each other, in such a manner that the lateral parts are movable in a limited manner in the axial and tangential direction of the piston and which in normal operation are guided towards the cylinder wall and the cam roll.

2. A piston as claimed in claim 1, wherein the lateral portions have a slide bearing surface against the cam roll which extends a distance both in front of and behind a plane extending through the center of rotation of the cam roll and perpendicular to the longitudinal axis of the piston.

3. A piston as claimed in claim 1, wherein each lateral portion tapers towards the top of the piston.

4. A piston as claimed in claim 1, having a motion-limiting means behind the piston and each lateral portion, which limits the motion of the lateral portion relative to the axial direction of the piston.

5. A piston as claimed in claim 1, wherein the lateral portions are made of a material which has low friction and high resistance of wear to iron/steel.

6. A piston as claimed in claim 5, wherein the material is a ceramic.

7. A piston as claimed in claim 5, wherein the lateral portions have a hard surface coating.

8. A hydraulic radial piston motor, having a piston according to claim 1.

9. A piston as claimed in claim 2, wherein each lateral portion tapers towards the top of the piston.

10. A piston as claimed in claim 2, having a motion-limiting means behind the piston and each lateral portion, which limits the motion of the lateral portion relative to the axial direction of the piston.

11. A piston as claimed in claim 3, having a motion-limiting means behind the piston and each lateral portion, which limits the motion of the lateral portion relative to the axial direction of the piston.

12. A piston as claimed in claim 2, wherein the lateral portions are made of a material which has low friction and high resistance of wear to iron/steel.

13. A piston as claimed in claim 3, wherein the lateral portions are made of a material which has low friction and high resistance of wear to iron/steel.

14. A piston as claimed in claim 4, wherein the lateral portions are made of a material which has low friction and high resistance of wear to iron/steel.

15. A piston as claimed in claim 9, wherein the lateral portions are made of a material which has low friction and high resistance of wear to iron/steel.

16. A piston as claimed in claim 10, wherein the lateral portions are made of a material which has low friction and high resistance of wear to iron/steel.

17. A piston as claimed in claim 11, wherein the lateral portions are made of a material which has low friction and high resistance of wear to iron/steel.

18. A hydraulic radial piston motor, having a piston according to claim 2.

19. A hydraulic radial piston motor, having a piston according to claim 3.

20. A hydraulic radial piston motor, having a piston according to claim 4.

* * * * *